US009049928B2

(12) United States Patent
Lesbirel

(10) Patent No.: US 9,049,928 B2
(45) Date of Patent: Jun. 9, 2015

(54) BOTTLE HOLDING DEVICE

(75) Inventor: Mitchell Douglas Lesbirel, Oakfield (CA)

(73) Assignee: Mitchell Douglas Lesbirel, Oakfield (CA)

( * ) Notice: Subject to any disclaimer, the term of this patent is extended or adjusted under 35 U.S.C. 154(b) by 0 days.

(21) Appl. No.: 13/536,054

(22) Filed: Jun. 28, 2012

(65) Prior Publication Data

US 2013/0233815 A1 Sep. 12, 2013

Related U.S. Application Data

(60) Provisional application No. 61/607,810, filed on Mar. 7, 2012.

(51) Int. Cl.

| | |
|---|---|
| ***A47B 73/00*** | (2006.01) |
| ***B65B 21/04*** | (2006.01) |
| ***B65B 35/56*** | (2006.01) |

(52) U.S. Cl.

CPC ..... *A47B 73/006* (2013.01); *Y10T 29/49826* (2015.01); *Y10T 29/49904* (2015.01); *B65B 21/04* (2013.01); *B65B 35/56* (2013.01)

(58) Field of Classification Search

CPC ..... A47B 73/004; A47B 73/006; A47G 23/0241; A47L 19/00; B08B 9/423; B67C 9/00; B65B 35/36; Y10T 29/49826; Y10T 29/49904

USPC ..... 211/74, 126.1, 133.6, 85.18, 60.1, 13.1; 206/562, 563, 564, 589

See application file for complete search history.

(56) References Cited

U.S. PATENT DOCUMENTS

| | | | | |
|---|---|---|---|---|
| 139,915 | A * | 6/1873 | Piper | 211/74 |
| 2,051,481 | A * | 8/1936 | Hudson | 294/87.24 |
| 2,419,040 | A | 4/1947 | Stepanian | |
| 2,522,912 | A * | 9/1950 | Weiss | 198/867.08 |
| 2,841,114 | A * | 7/1958 | Grant | 119/52.4 |
| 3,815,758 | A * | 6/1974 | Vandergeeten | 211/74 |
| 4,271,878 | A * | 6/1981 | Bologa | 141/375 |
| 4,349,109 | A * | 9/1982 | Scordato et al. | 206/562 |
| 4,567,981 | A * | 2/1986 | Headon | 206/597 |
| 4,735,321 | A * | 4/1988 | Day | 206/597 |
| 4,896,774 | A * | 1/1990 | Hammett et al. | 206/516 |
| 5,016,761 | A * | 5/1991 | Stoddard et al. | 211/59.4 |
| 5,105,860 | A | 4/1992 | Connor | |
| 5,149,041 | A | 9/1992 | Hartke | |
| 6,502,711 | B1 | 1/2003 | McRae | |
| 2004/0089621 | A1 * | 5/2004 | Gangloff | 211/74 |

(Continued)

FOREIGN PATENT DOCUMENTS

| | | | | |
|---|---|---|---|---|
| GB | 2253344 | A * | 9/1992 | A47B 73/00 |

OTHER PUBLICATIONS

90 Bottle drying tree : Midwest Supplies, http://www.midwestsupplies.com/90-bottle-drying-tree.html.

(Continued)

*Primary Examiner* — Joshua Rodden

(74) *Attorney, Agent, or Firm* — Gowling Lafleur Henderson LLP

(57) ABSTRACT

A holding device for holding a plurality of bottles. The holding device has a plurality of holding elements, each holding element having an interacting surface capable of engaging at least one of a neck and a shoulder of a respective bottle for holding the bottle upside down.

6 Claims, 12 Drawing Sheets

(56) References Cited

U.S. PATENT DOCUMENTS

| | | | | |
|---|---|---|---|---|
| 2007/0090070 | A1* | 4/2007 | Langham | 211/74 |
| 2007/0125725 | A1 | 6/2007 | Kemper et al. | |

OTHER PUBLICATIONS

Home-Brew Club—Part 5—Bottling / Craft Beer Academy, http://craftbeeracademy.com/home-brew-club-bottling/.
Beer Bottle Drying Rack Quickly by greggg on Sep. 22, 2012, http://www.instructables.com/id/Beer-Bottle-Drying-Rack-Quickly/.
Photo : drying rack, http://jefflovesjulie.com/gallery3/index.php/Making-Beer-Bottling-Day/HPIM1705.
Homemade bottle drying rack—Home Brew Forums—Mar. 10, 2009, http://www.homebrewtalk.com/f51/homemade-bottle-drying-rack-107984/.
Bottle sanitizing and drying alternatives?—p. 3—Home Brew Forums—May 17, 2011, http://www.homebrewtalk.com/f39/bottle-sanitizing-drying-alternatives-245817/index3.html.
Bottle drying rack—Home Brew Forums—Oct. 31, 2011, http://www.homebrewtalk.com/f51/bottle-drying-rack-277461/.
How Clean Are New Bottles?—p. 2, Wine Making Talk—Aug. 4, 2010, http://www.winemakingtalk.com/forum/f3/how-clean-new-bottles-8574/index2.html.
Homebrew Finds: Hands on with the More Beer Bottle Cleaning/Purging System—Jul. 20, 2012, http://www. homebrewfinds.com/2012/07/hands-on-with-more-beer-bottle.html.
Bottle Rack for CE970, MoreBeer, Aug. 4, 2010, http://morebeer.com/view_product/7272/102377/Bottle_Rack_For_CE970.
International Search Report dated Jul. 9, 2013, issued from the International Searching Authority, Canadian Intellectual Property Office for corresponding International PCT Patent Application No. PCT/CA2013/000199.
Written Opinion dated Jul. 9, 2013, issued from the International Searching Authority, Canadian Intellectual Property Office for corresponding International PCT Patent Application No. PCT/CA2013/000199.

* cited by examiner

BOTTLE HOLDING DEVICE

CROSS-REFERENCE

This application claims the benefit of U.S. Provisional Patent Application No. 61/607,810 filed Mar. 7, 2012.

FIELD

The present matter relates to containers and/or holding devices, and more particularly to a bottle holding device such as for collecting, draining, storing, organizing and/or transporting bottles.

BACKGROUND

Bars, pubs, restaurants and other establishments, locations and events where bottled beer is served often require bartenders and waiters to work at a fast pace, particularly during times when large quantities of bottled beer are sold. There are often a large number of empty bottles which have to be handled. Other locations where bottles may need to be collected include recycling depots and personal residences.

Typically, the handling of the empty bottles comprises the steps of: emptying liquid remaining in the bottles, for example, into a sink; collecting the bottles in containers—usually cardboard boxes the beer bottles have been delivered therein—containing, for example, 24 bottles; carrying the containers with the empty bottles to a storage location; and storing the containers. It is well-known that the handling of empty beer bottles is a tedious, time-consuming and potentially hazardous task, in particular, at peak times. For example, emptying liquid remaining in each bottle into the sink is a time-consuming process, as is properly disposing of each bottle into the cardboard box. Frequently, when done at a fast pace, bottles are broken resulting in shattered glass pieces being spilled over the work area. Furthermore, when liquid remaining in the bottles is not properly emptied, liquid may be spilled into the cardboard boxes, thus weakening the same and posing the risk of rupturing during handling/carrying.

BRIEF DESCRIPTION OF THE DRAWINGS

The subject matter is described below with reference to the accompanying drawings, in which.

DETAILED DESCRIPTION

There is described a holding device for holding a plurality of bottles. The holding device has a plurality of holding elements, each holding element having an interacting surface capable of engaging at least one of a neck and a shoulder of a respective bottle of the plurality of bottles for holding the bottle upside down.

Unless defined otherwise, all technical and scientific terms used herein have the same meaning as commonly understood by one of ordinary skill in the art to which the present subject matter belongs. Although any methods and materials similar or equivalent to those described herein can be used in the practice or testing of the present subject matter, certain methods and materials are now described by way of example.

While examples of holding devices will be described for holding empty beer bottles, it will become evident to those skilled in the art that the examples are representative only. They are also adaptable for holding various other types of bottles such as, for example, wine bottles.

Figure 1A:
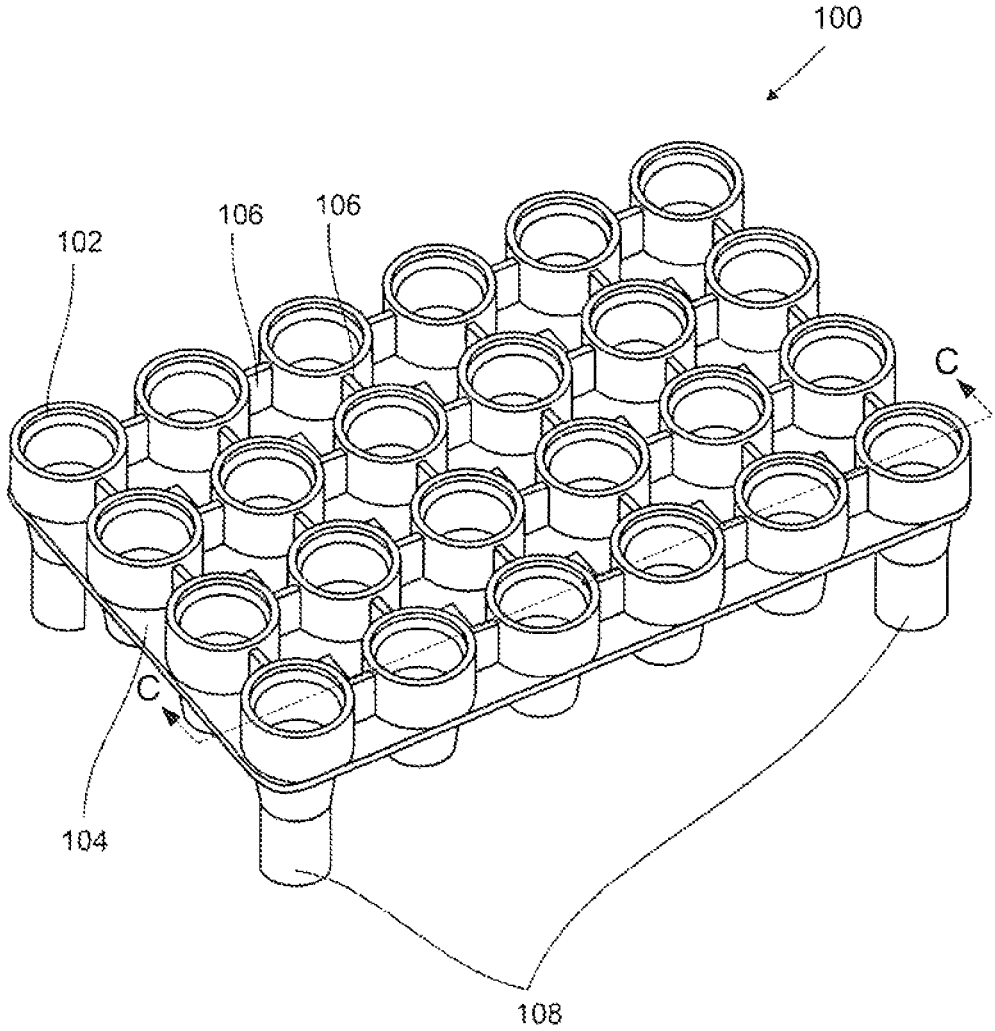
FIGS. 1A to 1C illustrate an isometric top view, an isometric bottom view, and an isometric cross sectional view, respectively, of an example holding device.
Figure 1B:
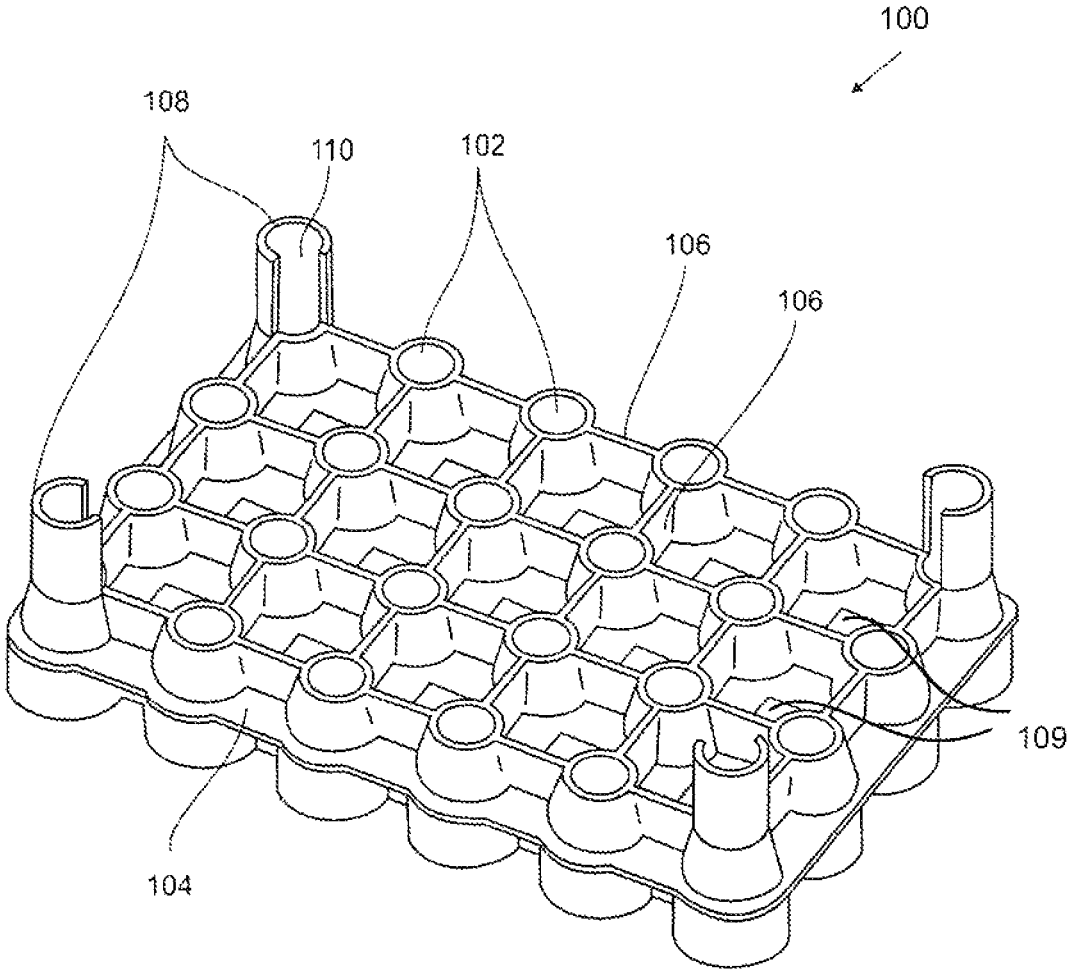
Figure 1C:
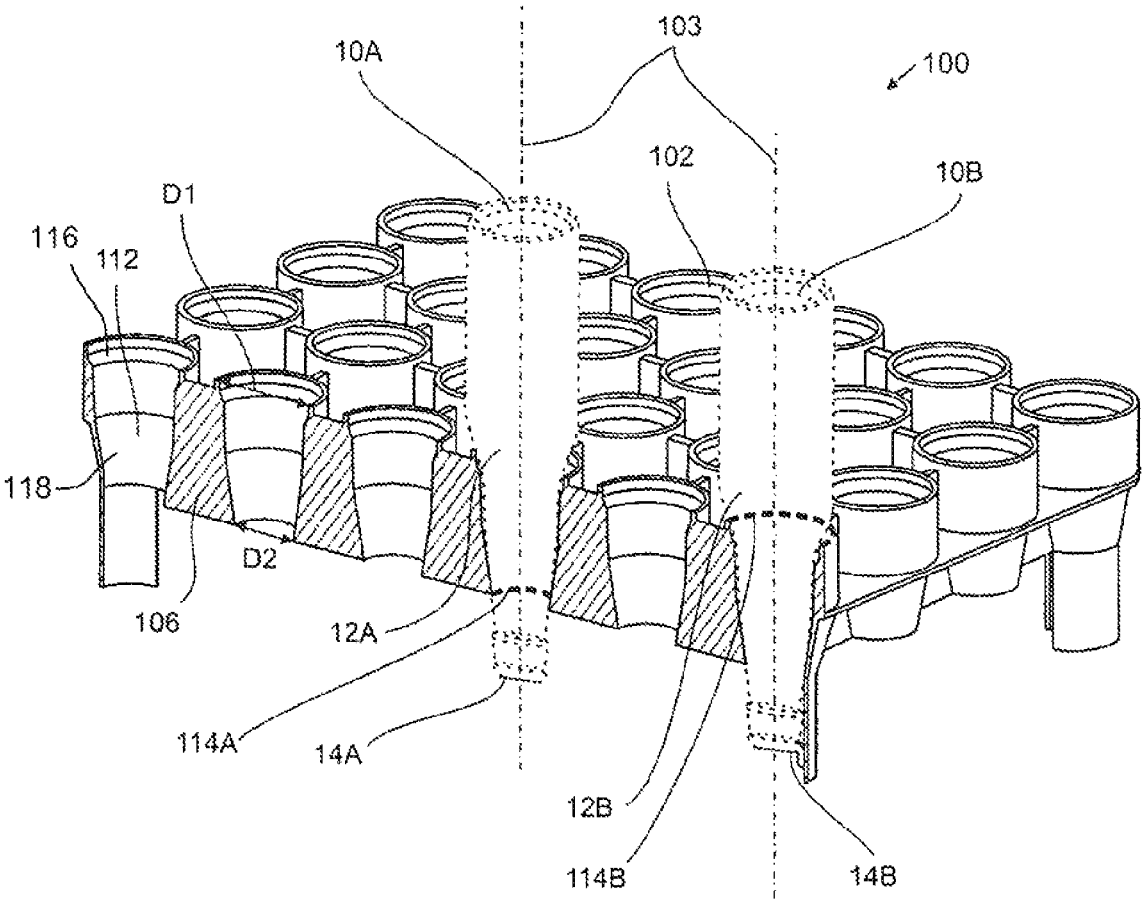

Referring to FIGS. 1A to 1C, a holding device 100 for holding a plurality of bottles according to one example is provided. The holding device 100 comprises a plurality of holding elements 102. In one example, the number of holding elements 102 is determined in dependence upon the number of bottles packaged by the brewery in a respective container such as a cardboard box for delivery, with the number of bottles being typically 12 or 24. The holding elements 102 can be arranged forming a predetermined array—as illustrated in FIG. 1A—resulting in an arrangement of the empty bottles that corresponds to the arrangement of the bottles as packaged by the brewery for reasons that will be described below. Of course, the design of the holding device is not limited thereto but is variable for different numbers of holding elements 102, as well as the arrangement of the same. For example, the number of holding elements may be a factor of the number of bottles as packaged by the brewery such as 4, 6 or 12 holding elements for a 24 bottle container, etc.

The holding device 100 further comprises a frame structure having the plurality of holding elements 102 connected thereto. In the present example, the holding elements 102 are disposed in a frame structure comprising a flat frame element 104 and ribs 106. Ribs 106 can be disposed on a top surface and/or bottom surface of the frame element 104, substantially perpendicular thereto, and connected to the respective holding elements 102 forming, for example, rows and columns of the predetermined array. Provision of the ribs 106 substantially increases the structural strength of the holding device 100, for example, with respect to bending when filled with bottles. The frame structure (e.g. flat frame element 104) may define apertures 109 between groups of holding elements 102, for example to reduce weight and material usage. In an other example (not shown), the frame structure comprises ribs 106 between the holding elements 102 and flat frame element 104 may be minimized or eliminated thus having apertures 109 that are larger in the frame structure.

FIG. 1C is a perspective cross-sectional view along the line C-C of FIG. 1A showing example bottles 10A and 10B (illustrated in broken lines) in two of the holding elements 102. At least some of the holding elements 102 can be of cylindrical shape having a funnel-shaped bore 112. The holding elements have one or more interacting surfaces that receive and support the bottles about one or more side surfaces of the bottles, for example, to engage at least one of the neck, shoulder and body side of the bottle. The interacting surfaces of the holding elements may be shaped and/or dimensioned to snugly engage the bottles.

In the present example bore 112 has an upper cross section with a first diameter D1 and a lower cross section with a second smaller diameter D2. The surface of the bore 112 is designed to interact and engage with an upper portion 12A, 12B of a respective bottle 10A, 10B for holding the same in an inverted orientation, as illustrated in FIG. 1C. Generally, diameter D1 is sized to receive a shoulder of a bottle and diameter D2 is sized to receive a neck of a bottle. As illustrated in FIG. 1C, the surface of the bore 112 is designed to interact and engage with bottles having different shapes. For example, relatively wide bottles 10B—used in Canada, for example, by Sleemans™ and some other brewers—contact and engage the surface of the bore 112 at the top about the shoulder of the bottle, as indicated by the line 114B in FIG. 1C, while relatively slim bottles 10A—used, for example, for products sold in Canada under the Coors™, Molson™, and Corona™ marks—contact and engage the surface of the bore 112 at the bottom of the bore, about the neck of the bottle, as indicated by the line 114A in FIG. 1C. Further, the diameter D2 may be sized for enabling a top end 14A, 14B of the bottle (the bottle opening end) to protrude therethrough. Of course, the design of the holding element is not limited thereto but is adaptable to accommodate various sizes and shapes of bottles.

Further, the diameter D1 and the shape of the bore 112 can be determined to be capable of guiding the top end 14A, 14B of the bottle 10A, 10B towards the bottom end of the bore 112 in situations when the bottle is not provided substantially along the axis 103 but at an angle thereto, which frequently occurs when bottles are collected at a fast pace. For example, the diameter D1 and the shape of the bore 112 are determined to provide guidance to the top end 14A, 14B of the bottle 10A, 10B for provision of the bottles at angles up to approximately 30° to the axis 103. Providing guidance to the top end 14A, 14B of the bottle 10A, 10B substantially facilitates the collection of the bottles in the holding device 100. An upper tapered element 116 may provide a first transition from the first diameter D1 to facilitate the insertion of the bottle into the lower portion of the bore 112, and a lower tapered element 118 provides a second transition to further facilitate the insertion of the bottle into the bottom of the bore 112. Though not shown, holding elements 102 may be elongated and dimensioned to a third diameter (not shown) above upper tapered element 116 thereby to extend the holding member to receive at least a portion of the side of the body of the bottle.

The bottom of the bore may be partially blocked by a rail or other blocking element (not shown) that prevents the opening end of the inverted bottle from passing out of the bottom of the bore 112 but allows any liquid to empty from the inverted bottle into, for example, a drip tray positioned below the holding device 100 as more fully described herein. Though illustrated as a funnel-shaped bore, at least some of the holding elements may take other shapes. For example, the holding element may comprise an upper cylinder and a lower cylinder in communication with one another, with a diameter of the upper cylinder being larger than a diameter of the lower cylinder. Such a holding element may be configured with an abrupt transition between the two diameters (i.e. without a gradual transition between the respective diameters of the cylinders). Where the upper cylinder communicates with the lower cylinder, the abrupt transition may be considered to form a partial bottom relative to the upper cylinder or an outer flange about the top of the lower cylinder. In one configuration, the upper cylinder and/or abrupt transition may be sized to engage a shoulder of a bottle and the lower cylinder sized to engage a neck of a bottle.

Though shown as solid structures, the surface of the holding elements 102 may be defined with one or more apertures, for example to reduce weight and material usage. The surface of the holding elements may appear as a mesh or grid having apertures. Though shown with holding elements to support the bottles in a generally vertical orientation when the holding device is on a horizontal surface, the axis of the holding elements may be angled from vertical.

The holding device 100 further comprises a plurality of support elements 108 protruding a predetermined distance from a bottom side of the holding device 100. For example, four support elements 108 are disposed in proximity of the four corners of the holding device 100, as illustrated in FIG. 1B. The support elements 108 need not be positioned on the corners but may be positioned inwardly, toward the center of the holding device 100 or at other points along the periphery of the holding device 100 such as at the mid point of each side. The support elements 108 may be of substantially cylindrical shape and formed as an extension of the respective holding elements 102 disposed in proximity of the four corners of the holding device 100. An opening or cut-out 110 can be disposed in a respective support element 108 in order to provide a conduit for liquid dripping out of a bottle disposed in the respective holding element 102.

Figure 2A:
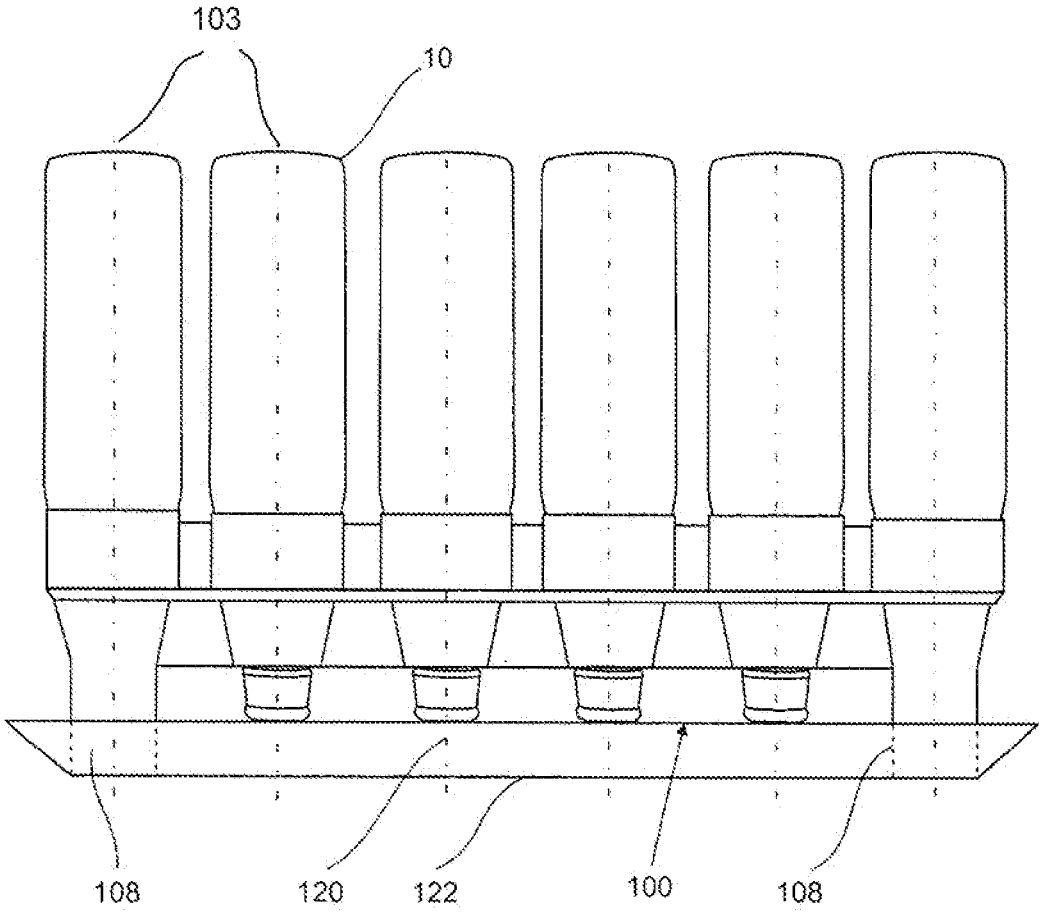
FIG. 2A illustrates a front view of the holding device of FIGS. 1A to 1C holding representative bottles and placed in a drip tray.

Referring to FIG. 2A, the holding device 100 in one example has a drip tray 120 associated therewith for substantially catching liquid dripping from the plurality of bottles 10 (illustrated in solid lines) that have been inserted in an inverted manner into the upright holding device 100. The drip tray 120 can be designed for having the support elements 108 (illustrated partially in broken lines) disposed on a floor 122 in proximity of the four corners thereof. Optionally, guiding elements (not shown) are disposed at respective locations on the floor 122 for guiding placement of the respective support elements 108. Provision of the drip tray 120 may assist with the draining of the bottles prior to insertion into a container, for example, for storage and/or return for recycling. The bottles in holding device 100 may be drained over a sink or bus tray. It will be appreciated that while the bottles in FIG. 2A illustrate identical bottles positioned within the holding device, a variety of differently shaped and sized bottles may be positioned in the holding device 100.

Figure 2B:
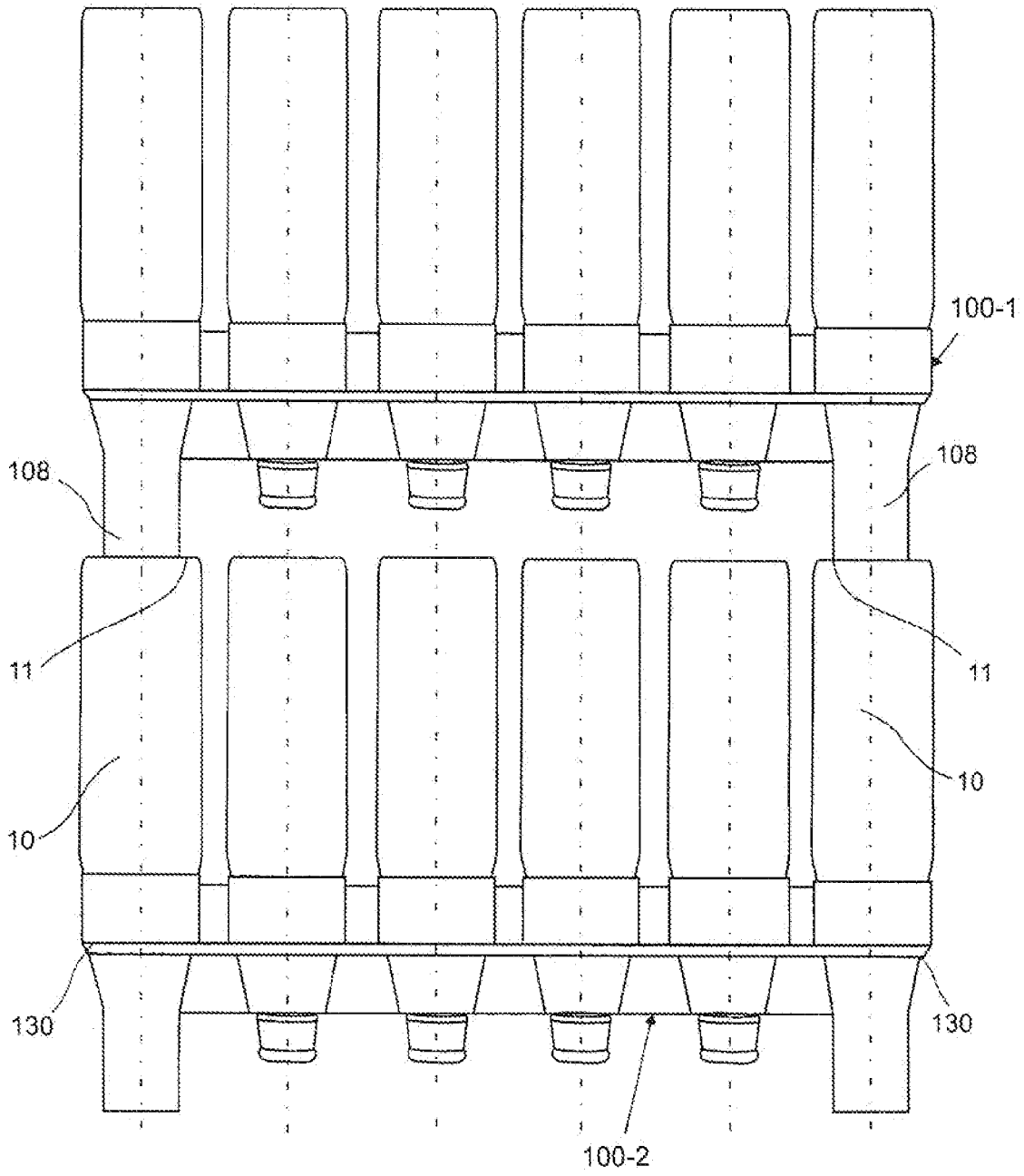
FIG. 2B illustrates a front view of two holding devices of FIGS. 1A to 1C holding representative bottles and shown in a stacked configuration.

The support elements 108 may be placed such that stacking of a plurality of holding devices 100 with bottles is enabled, as illustrated in FIG. 2B. Here, the support elements 108 of an upper holding device 100-1 are in contact with a bottom 11 of a respective bottle 10 disposed in a lower holding device 100-2. Stacking as illustrated in FIG. 2B substantially facilitates storing of the bottles, as well as carrying, for example, by holding the lower holding device 100-2 at a left hand side and a right hand side edge 130. Optionally, a handle (not shown) is provided at the edges 130, for example, connected to the frame element 104. Alternatively (not shown), the support elements 108 are disposed separate from the holding elements 102, for example, protruding from the frame element 104 at locations outside projected cross-sections of the bottles 10. A holding device 100 may be then stacked with another by contacting the support elements 108 of an upper holding device 100-1 with an upper surface of the frame element 104 of a lower holding device 100-2 at respective locations. Though two holding devices are shown in a stacked configuration, more holding devices may be stacked together.

Figure 3A:
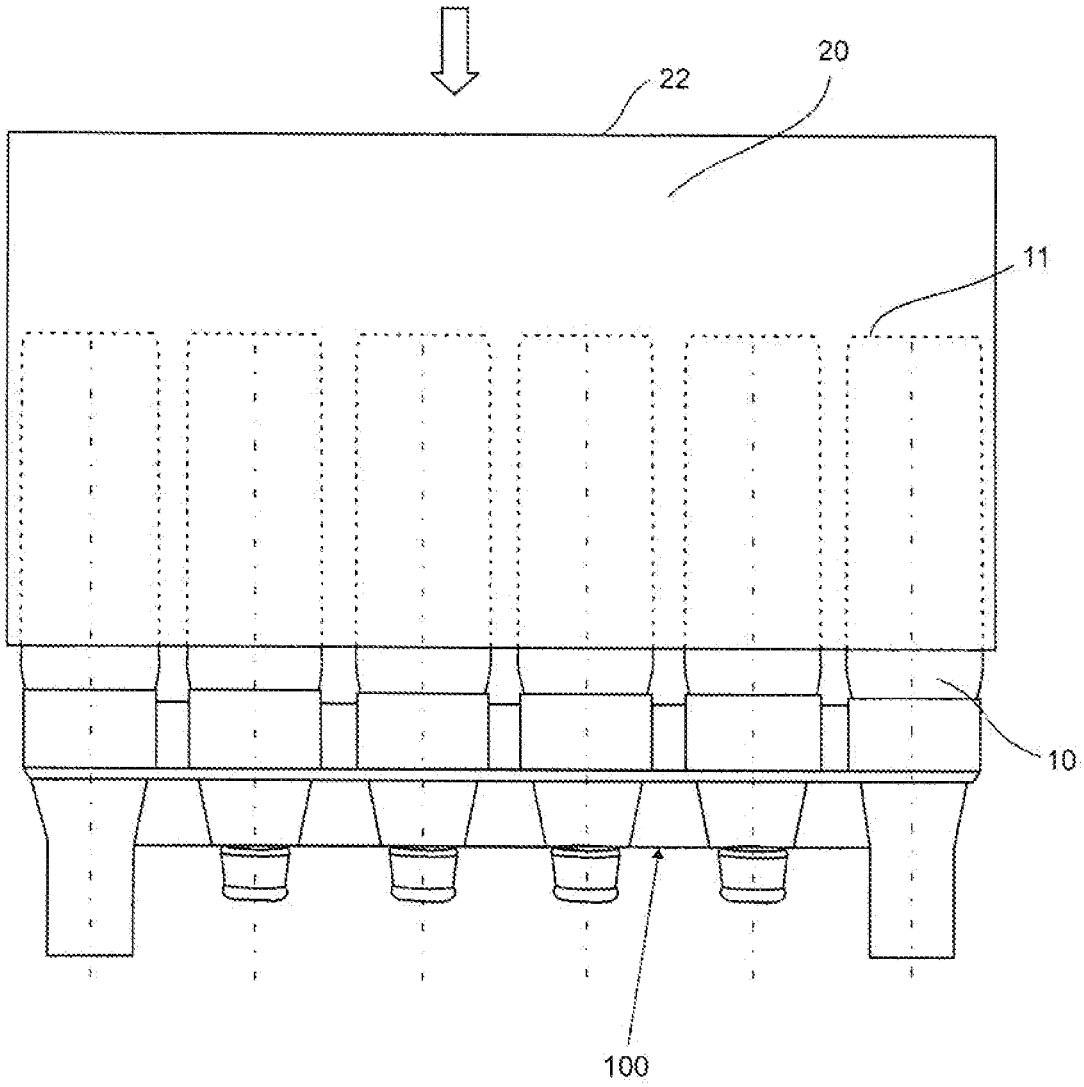
FIGS. 3A to 3C illustrate in front views the filling of bottles into a respective container, in accordance with an example, using the holding device of FIGS. 1A to 1C.
Figure 3B:
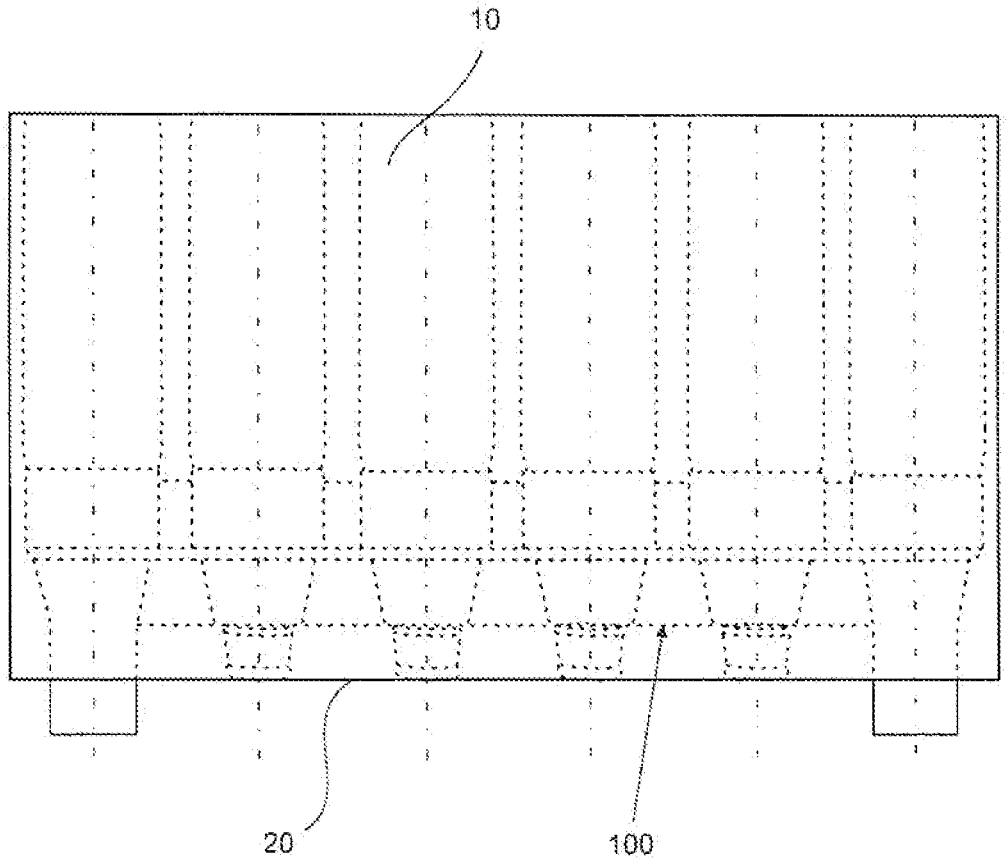
Figure 3C:
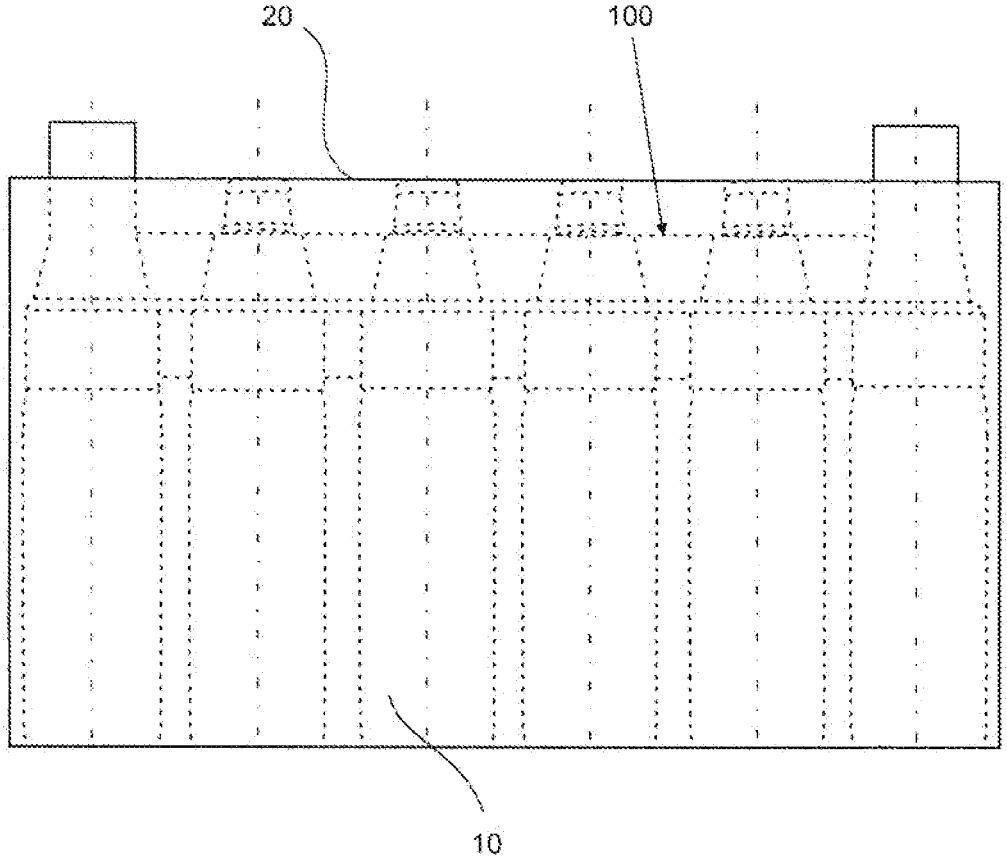

The holding elements 102 can form a predetermined array resulting in an arrangement of the empty bottles that corresponds to the arrangement of the bottles as packaged by the brewery, i.e. the plurality of bottles 10 when disposed in the respective holding elements 102 of the holding device 100 fit inside a predetermined container such as, for example, a cardboard box in which the bottles have been delivered. It is also understood that the bottles in a holding device 100 may be stored to a container configured to receive more bottles than the holding device 100. As illustrated in FIGS. 3A to 3C, the holding device 100 is, in one example, designed to fit inside container 20 allowing the container 20 to be put oriented upside down—over the bottles 10 and the holding device 100, as indicated by the block arrow in FIG. 3A, until the inside bottom 22 of the container 20 is adjacent with the bottom 11 of the bottles 10, as illustrated in FIG. 3B. Some of the bottles adjacent the inside bottom 22 may be in contact therewith. Others may not, for example because the bottles are of a different size and/or because some of the bottles have been inserted further into the holding elements 102. The container 20—with the bottles 10 and the holding device 100—are then inverted (the holding device being temporarily securely positioned within the container so as to maintain its position within the box during the inverting step) so that the container and bottles are in an upright orientation, with the bottles properly positioned within the upright container, as illustrated in FIG. 3C, and thereafter, the holding device 100 is removed. The process illustrated in FIGS. 3A to 3C substantially facilitates filling of the containers 20 for returning the empty bottles 10, for example, for recycling.

Figure 4A:
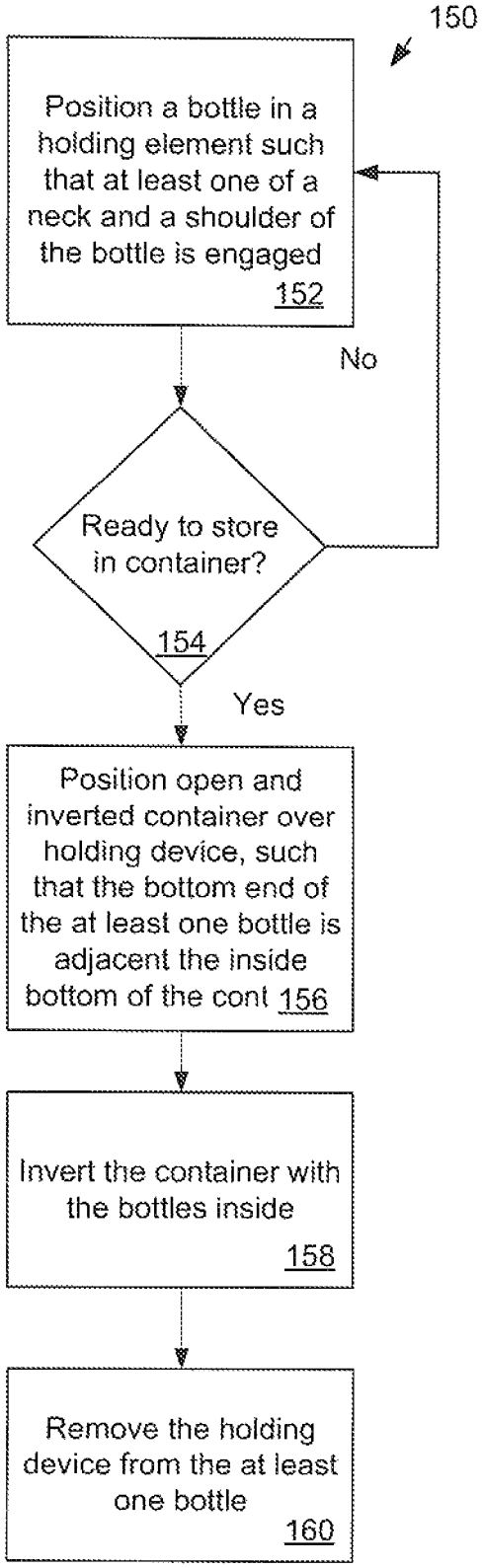
FIGS. 4A and 4B are flowcharts illustrating method operations.

FIG. 4A illustrates a flowchart of operations 150 for a method of packing bottles into a container. At 152, a bottle is positioned in a holding element such that at least one of a neck and a shoulder of the bottle is engaged. At 154 a determination is made whether to store the bottles into a container (via yes branch to 156) or to continue positioning bottles (via no branch to 152). The holding device need not be full of bottles. Bottles in the holding device may drain at least some of their respective contents. The holding device 100 may be placed over a sink, drip tray, bus tray, etc., whether before or after receiving bottles for draining.

When ready to store in to a container, a suitable container to fill is obtained. The suitable container may be empty of bottles. The container may be configured to receive bottles in a predetermined array. At 156 the open and inverted container is positioned over the holding device with at least one bottle engaged. The container is positioned such that the bottom end of the at least one bottle is adjacent the inside bottom of the container. As noted, some of the bottle bottoms may be in contact with the inside bottom. At 158, the container is inverted with the bottles (as well as the holding device) inside such that the bottles are upright. At 160, the holding device is removed from the at least one bottle, leaving the at least one bottle in the container.

Figure 4B:
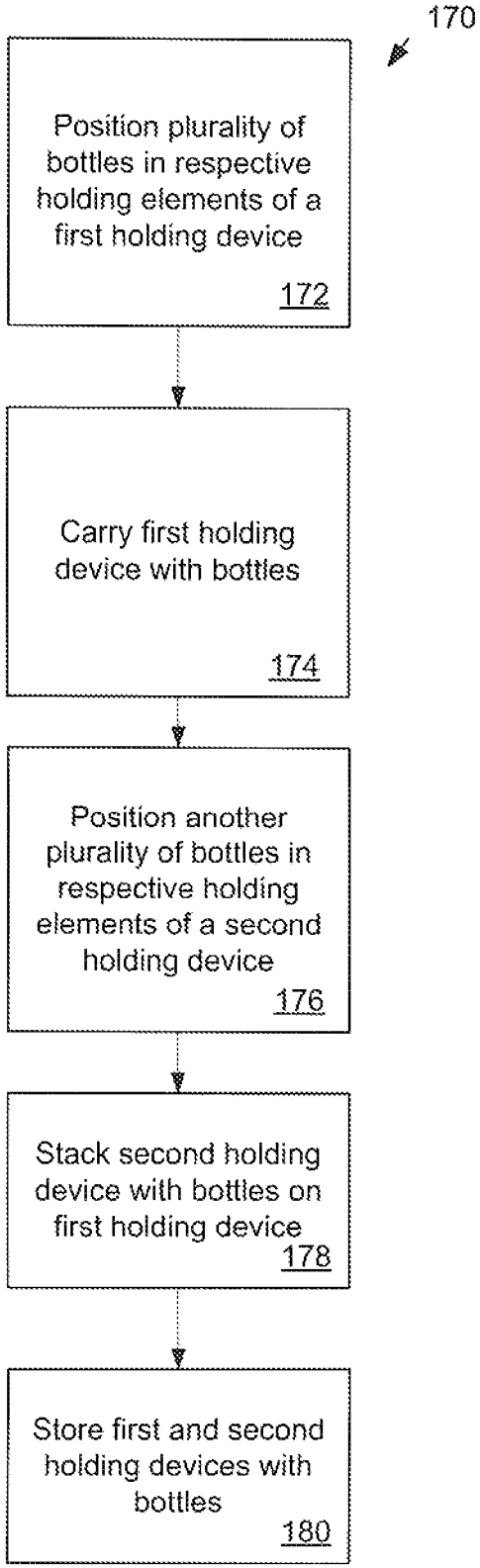

FIG. 4B is a flowchart illustrating operations 170 for filling holding devices with bottles, carrying a holding device and stacking holding devices for storing bottles. At 172, a plurality of bottles are positioned in respective holding elements of a first holding device. Each bottle is positioned in a respective holding element such that the holding element engages at least one of a neck and shoulder of the bottle. The first holding device may be oriented to support the bottle upside down in the holding element, for example, to assist with draining the bottle. Optionally the plurality of bottles may fill the first holding device such that no holding element is without a bottle. At 174, the first holding device with bottles is carried, for example to a storage location.

At 176, another plurality of bottles is positioned in respective holding elements of a second holding device. Optionally the plurality of bottles may fill the second holding device such that no holding element is without a bottle. Each bottle is positioned in a respective holding element such that the holding element engages at least one of a neck and shoulder of the bottle. The second holding device may be oriented to support the bottle upside down in the holding element, for example, to assist with draining the bottle. The second holding device may be carried to the first holding device. At 178, the second holding device with bottles is stacked on the first holding device with bottles. At 180, the first and second holding devices with bottles are stored. Optionally, the bottles of the respective first and/or second holding device may be positioned into containers, for example, following operations 156 to 160.

Holding device 100 is designed using standard engineering technology and can be made of a suitable plastic material such as, for example, Polyvinyl Chloride (PVC) or Polypropylene (PP) using a standard injection molding process. Alternatively, the holding device 100 is made of wood, rubber or a suitable alloy or metal, such as, for example, aluminum. As is evident to one skilled in the art, the design of the holding device 100 is not limited to the examples described hereinabove. Holding elements 102 may comprise deflectable fingers (not shown), for example, at least partially extending over bore 112, into bore 112 or both over and into, providing interacting surfaces for engaging the side of the bottle such as about at least one of the neck and shoulder. The fingers may be constructed of a suitable plastic and/or rubber material. For example, the holding elements 102 are provided as circular-shaped structures disposed in at least two parallel planes with the circular-shaped structures associated with a respective holding element 102 having different diameters and being substantially coaxially aligned. The circular-shaped structures may be provided, for example, as a ring-shaped wire structure (not shown).

Figure 5:
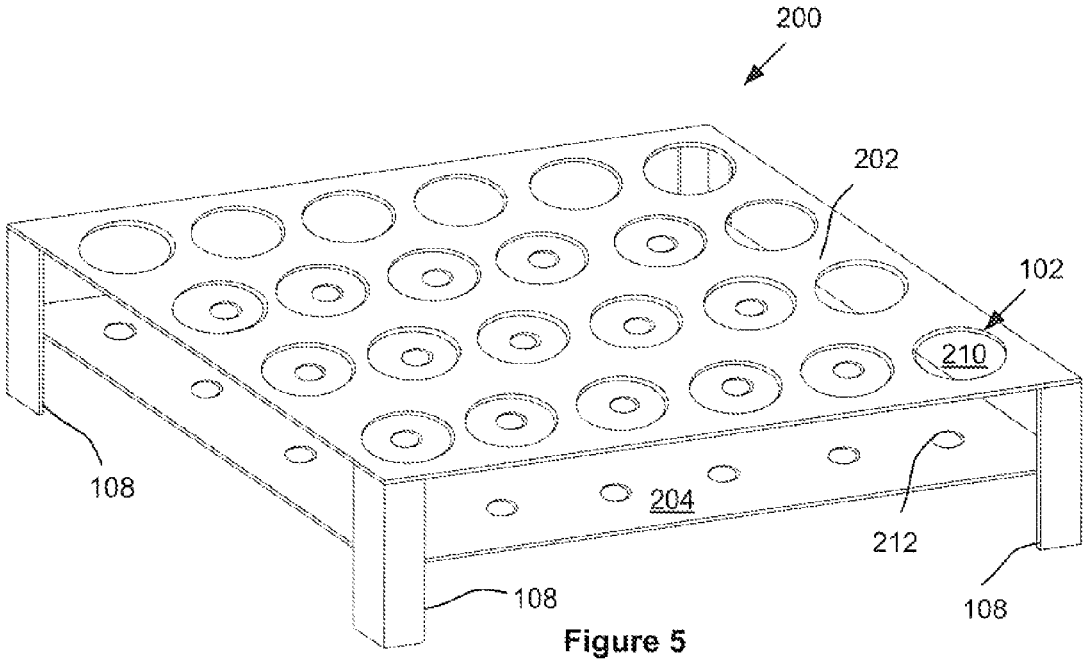
FIGS. 5 and 6 illustrate respective top isometric views of holding devices in accordance with two examples.

FIG. 5 illustrates an isometric top view of a holding device 200 in accordance with a further example. In this FIG. 5, like portions and elements of holding device 200 are referenced by identical reference numbers as used to describe holding device 100. In some instances, the shape and/or size of the portions or elements may appear slightly different. For example, support elements 108 are different in size and/or shape. Holding device 200 comprises an upper surface 202 and a lower surface 204 in secure spaced engagement with one another. The upper surface 202 and lower surface 204 may be spaced by support elements 108. Each of the upper surface and lower surface may comprise a generally planer element. Support elements 108 may also support the upper surface 202 and lower surface 204 above a work or storage surface.

At least some of the holding elements 102 may be in the form of a large upper hole 210 in the upper surface 202 sized to be slightly larger than the diameter of the bottle to be inserted therethrough, and a corresponding small lower hole 212 in the lower surface 204, the lower hole 212 being of a size to snugly engage at least one of the neck and shoulder of the inverted bottle inserted into the holding element 102. The upper and lower holes 210, 212 are substantially aligned with one another. That is in a top view, a respective lower hole is generally centered within a respective upper hole to support a bottle in a generally vertical position (e.g. when the support elements are positioned on a generally horizontal surface). The shape of the holes 210, 212 may be circular as shown or rectangular or other shape to accommodate the insertion of the bottle. The periphery of the holes in the respective surfaces provide interacting surfaces for supporting the bottle. At least some of the holding elements 102 may comprise deflectable fingers (not shown) at least partially extending into, over or both at least one of the upper or lower holes 210, 212 providing interacting surfaces for engaging the side of the bottle such as about at least one of the neck and shoulder. The fingers may be constructed of a suitable plastic and/or rubber material. The holding elements 102 form a predetermined array. The predetermined array may correspond to the arrangement of the bottles as packaged by the brewery. The predetermined array may correspond to another arrangement, such as for a container for storing and/or transporting empty bottles configured by another entity.

Holding device 200 may also be designed using standard engineering technology and can be made of a suitable plastic material such as, for example, Polyvinyl Chloride (PVC) or Polypropylene (PP) using a standard injection molding process. Alternatively, the holding device 200 is made of wood, rubber or a suitable alloy or metal, such as, for example, aluminum.

Figure 6:
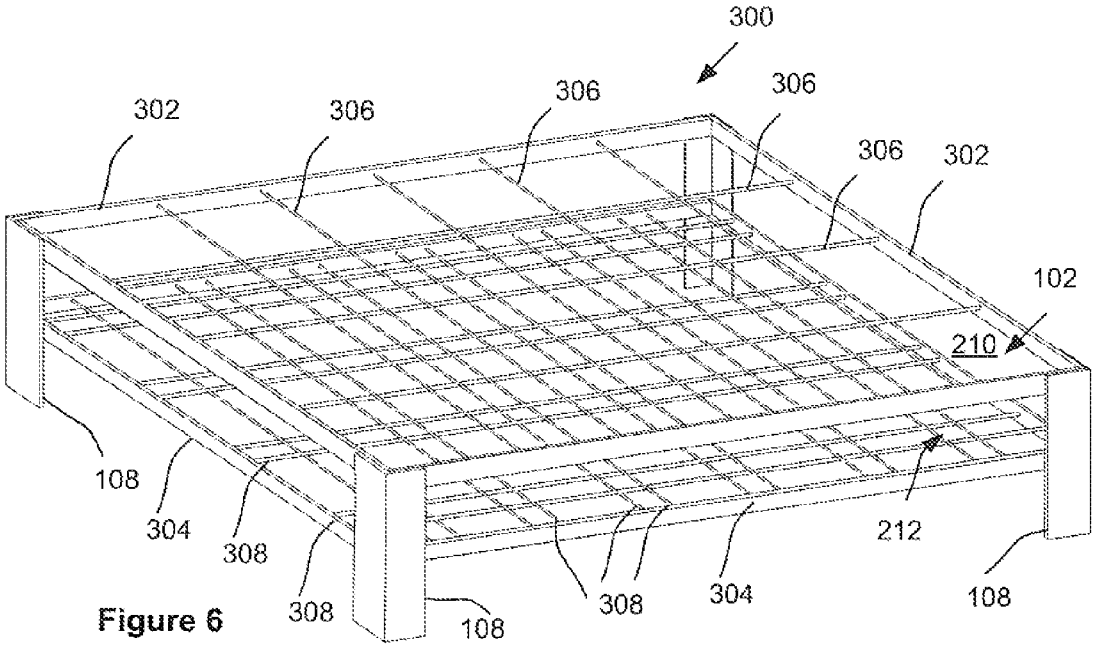

FIG. 6 illustrates an isometric top view of a holding device 300 in accordance with a further example. In FIG. 6, like portions and elements of holding device 300 are referenced by identical reference numbers as used to describe holding device 100. In some instances, the shape and/or size of the portions or elements may appear slightly different. For example, support elements 108 are different in size and/or shape. Holding device 300 comprises an upper frame element 302 and a lower frame element 304 in secure spaced engagement with one another. The frame elements 302 and 304 may be spaced by support elements 108. Support elements 108 may support the frame elements 302 and 304 above a work or storage surface. Upper frame element 302 is connected to a plurality upper cross wires 306 in spaced relation defining an upper surface. Lower frame element 304 is connected to a plurality of lower cross wires 308 in spaced relation defining a lower surface. Though described as wires, other forms of cross elements may be used.

At least some of the holding elements 102 may be in the form of a large upper hole 210 defined by portions of respective adjacent upper cross wires 306 providing an interacting surface and a corresponding small lower hole 212 defined by portions of respective adjacent lower cross wires 308 providing an interacting surface. The holding elements 102 form a predetermined array resulting in an arrangement of the empty bottles that corresponds to the arrangement of the bottles as packaged by the brewery. The upper and lower holes 210, 212 are substantially aligned with one another in the present example. That is in a top view, a respective lower hole is generally centered within a respective upper hole to support a bottle in a generally vertical position (e.g. when the support elements are positioned on a generally horizontal surface).

The respective adjacent upper cross wires 306 defining a particularly upper hole 210 are spaced to be slightly larger than the diameter of the bottle to be inserted. The respective adjacent lower cross wires 308 defining a particularly lower hole 212 are spaced to engage at least one of the neck and shoulder of the inverted bottle inserted into the holding element 102.

The respective cross wires 306 and 308 in the present example are straight and arranged to be parallel to define generally square shaped upper and lower holes 210 and 212. The cross wires 306 and 308 may be shaped, for example, slightly curved in sections thereof, about the holes to define more rounded shaped holes. Other shapes may also be formed to accommodate the insertion of the bottle.

Any of frame elements 302 and 304 and support elements 108 may also be in the form of wire structures.

Holding device 300 may also be designed using standard engineering technology and can be made of a suitable plastic material such as, for example, Polyvinyl Chloride (PVC) or Polypropylene (PP) using a standard injection molding process. Alternatively, the holding device 200 is made of rubber or a suitable alloy or metal, such as, for example, aluminum. The metal may be coated with a suitable plastic.

Figure 7A:
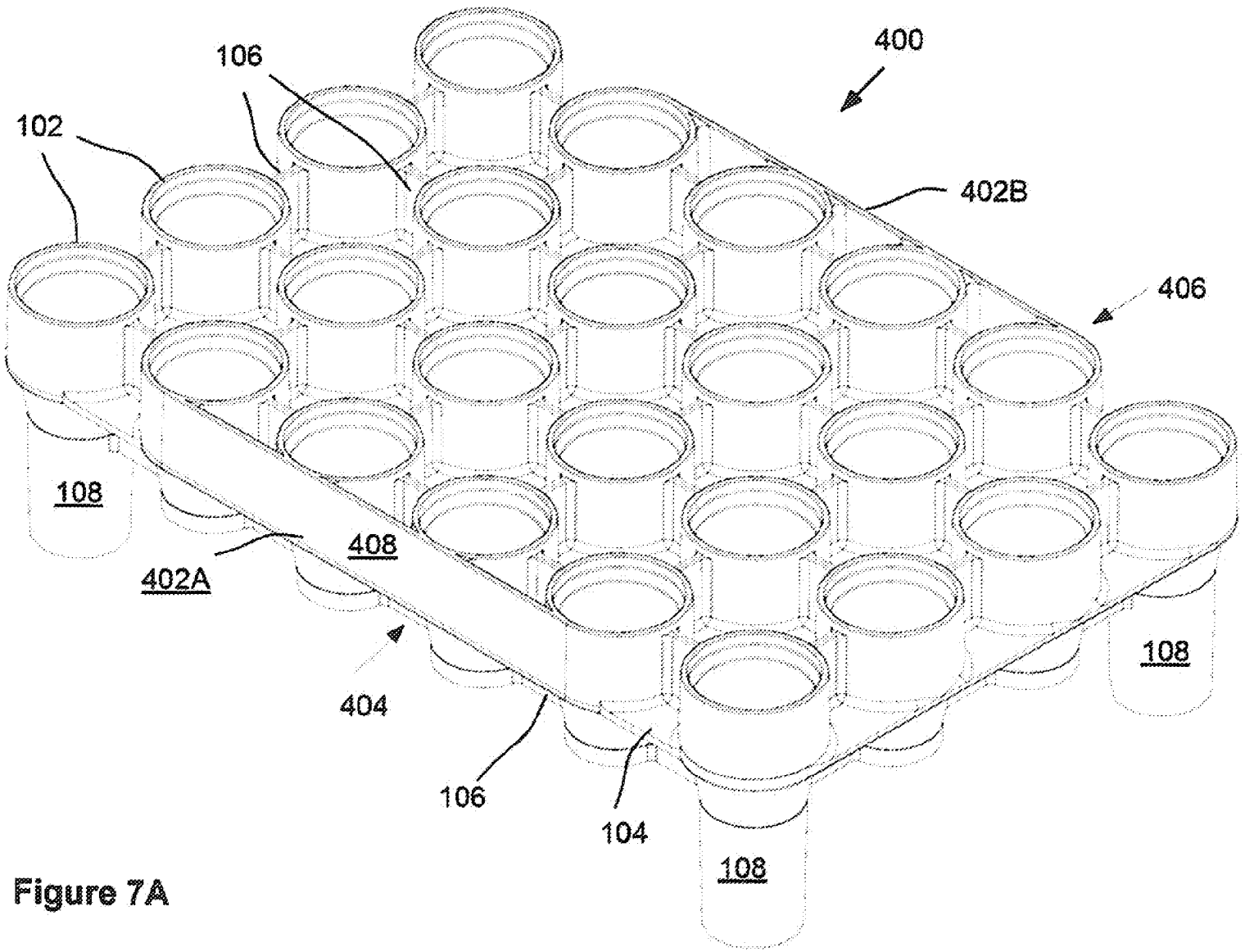
FIGS. 7A and 7B illustrate an isometric top view and an isometric bottom view of a holding device in accordance with a further example.
Figure 7B:
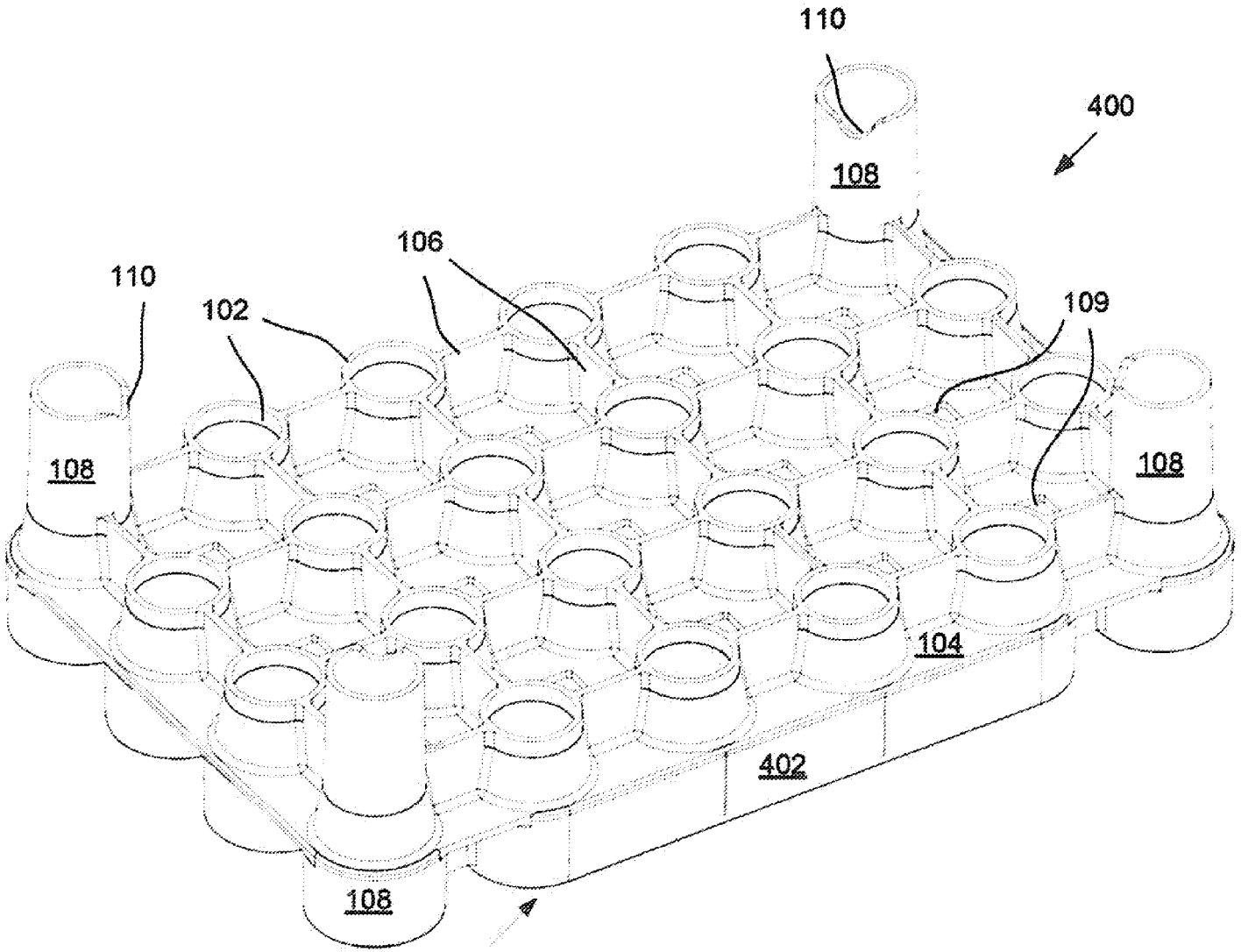

FIGS. 7A and 7B illustrate an isometric top view and an isometric bottom view of a holding device 400 in accordance with a further example. In these FIGS. 7A and 7B, like portions and elements of holding device 400 are referenced by identical reference numbers as used to describe holding device 100. In some instances, the shape and/or size of the portions or elements may appear slightly different. For example, support elements 108 are different in size and/or shape as is each cut-out 110.

Holding device 400 comprises a side element 402A and a side element 402B on opposite sides 404 and 406 thereof. One or more side elements may be present on holding device 400 and need not be on opposite sides. Side element 402A and side element 402B in the present example are connected to some of the holding elements 102 that are adjacent and near the respective sides 404 and 406. Side element 402A and side element 402B in the present example are also connected an exterior side margin of frame element 104 along respective sides 404 and 406. In other configurations (not shown), a side element may be connected only to one or more holding elements 102 or to frame element 104. The holding elements to which the side element is connected need not be adjacent. In the present example, the side elements are configured so as to avoid interference with a container when placing the bottles into the container.

A side element (e.g. 402A) may provide surface (e.g. 408), which may be generally flat, extending along at least a portion of a side (e.g. 404) of the holding device 200, on which to present information (not shown). Information may comprise brand information or other advertising, instructions for use, warnings (e.g. against drinking and driving), etc. The brand information may comprise a brand of a brewery or a serving establishment for example. Information may be applied to the surface of the side element (e.g. via a carrier with adhesive (e.g. a sticker)) or formed on the surface (e.g. during manufacturing), etc. As shown, side element 402A and side element 402B are integrally formed with the holding device but it is understood that in some examples they may be separately constructed and assembled. A side element may assist with torsional strengthening of the holding device 400.

Holding device 400 may also be designed using standard engineering technology and can be made of a suitable plastic material such as, for example, Polyvinyl Chloride (PVC) or Polypropylene (PP) using a standard injection molding process. Alternatively, the holding device 400 is made of rubber or a suitable alloy or metal, such as, for example, aluminum.

The holding devices in accordance with the various examples may assist with one or more of bottle collecting, emptying, storing, stacking and/or carrying. Positioning bottles in the holding devices in the upside down configuration may assist with draining of liquid left in the bottles to be collected. The holding devices in accordance with the various examples may assist with collecting, storing, and carrying empty bottles for example to assist with organizing a bar or other location. The holding devices in accordance with the various examples may assist with collecting, storing, and carrying empty bottles in a predetermined arrangement. Such holding devices may assist with a transfer of bottles to a respective container, such as a container having a corresponding predetermined arrangement.

The holding device and method of use have been described herein with regard to certain examples. However, it will be apparent to persons skilled in the art that a number of variations and modifications can be made thereto. The scope of the claims should not be limited by the specific examples, but should be given the broadest interpretation consistent with the description as a whole.

What is claimed is:

1. A method of bottle collection comprising the steps of:

positioning at least one bottle in a holding device such that at least one of a neck and a shoulder of the at least one bottle is engaged in one of a plurality of holding elements of the holding device, each of the plurality of holding elements having an interacting surface to receive the at least one of a neck and a shoulder of the at least one bottle to hold the bottle upside down; the plurality of holding elements arranged in an array such that the at least one bottle, when disposed in the respective one of the holding elements, and the holding device fit inside a predetermined container closely adjacent to side walls of the predetermined container such that the holding device is securely positioned within the predetermined container to maintain the holding device and the at least one bottle therein when inverting the container;

positioning the predetermined container in an open and inverted configuration over the at least one bottle such that a bottom end of the at least one bottle is adjacent an inside bottom of the predetermined container and the holding device is securely positioned within the container to maintain the holding device and the at least one bottle therein when inverting the container;

inverting the predetermined container with the at least one bottle; and removing the holding device from the at least one bottle in the predetermined container.

2. The method of claim 1 wherein a plurality of bottles are collected to the holding device and a second holding device and wherein the method further comprises stacking the holding device and the second holding device with the plurality of bottles.

3. The method of claim 1 comprising placing a plurality of bottles in respective ones of the holding elements and draining the plurality of bottles before positioning the predetermined container.

4. The method of claim 3 wherein the holding device comprises a plurality of support elements protruding a predetermined distance from a bottom side of a frame structure connecting the plurality of holding elements to space the bottom side above a draining surface, the support elements comprising an extension of the bottom of some of the respective holding elements to extend the interacting surface having a funnel shape beyond the bottom side of the frame structure and wherein the method comprises draining at least some of the plurality of bottles through the support elements.

5. The method of claim 1 wherein the predetermined container is a cardboard beer bottle box.

6. The method of claim 1 wherein the interacting surface is a funnel shaped surface.

* * * * *